US005466341A

United States Patent [19]

Kankaanpää

[11] Patent Number: 5,466,341

[45] Date of Patent: Nov. 14, 1995

[54] METHOD FOR DRAINING WATER FROM A PAPER WEB

[75] Inventor: Matti Kankaanpää, Espoo, Finland

[73] Assignee: Valmet Paper Machinery, Inc., Helsinki, Finland

[21] Appl. No.: 396,379

[22] Filed: Feb. 28, 1995

Related U.S. Application Data

[62] Division of Ser. No. 128,470, Sep. 28, 1993.

[30] Foreign Application Priority Data

Jul. 7, 1993 [FI] Finland ..... 933112

[51] Int. Cl.[6] ..... D21F 1/48

[52] U.S. Cl. ..... 162/217; 162/306; 162/349; 162/DIG. 7

[58] Field of Search ..... 162/203, 217, 162/306, 357, 368, 372, 373, 349, DIG. 7; 492/20, 55

[56] References Cited

U.S. PATENT DOCUMENTS

| | | | |
|---|---|---|---|
| 2,991,218 | 7/1961 | Cirrito et al. | 162/357 |
| 3,013,605 | 12/1961 | Justus | 162/349 |
| 3,057,402 | 10/1962 | Webster | 162/368 |
| 3,082,819 | 3/1963 | Justus et al. | 162/349 |
| 3,325,351 | 6/1967 | Orton, Jr. | 162/358.1 |
| 3,518,161 | 6/1970 | Ekberg | 162/374 |
| 3,876,500 | 4/1975 | Csordas et al. | 162/300 |
| 4,172,759 | 10/1979 | Kankaanpaa | 162/205 |
| 4,414,061 | 11/1983 | Truffitt et al. | 162/301 |
| 4,925,531 | 5/1990 | Koski | 162/301 |

*Primary Examiner*—Karen M. Hastings
*Attorney, Agent, or Firm*—Steinberg, Raskin & Davidson

[57] ABSTRACT

A suction roll for a paper machine in which a stationary suction shoe is arranged inside a revolving mantle loop and is connected to a source of negative pressure. The mantle loop is a substantially water-receiving and permeable fabric-sock loop that receives water and is, in a preferred embodiment, supported by means of guide members arranged inside the loop. The suction shoe is provided with a permeable guide deck against which the inner face of the fabric-sock loop glides.

10 Claims, 5 Drawing Sheets

METHOD FOR DRAINING WATER FROM A PAPER WEB

This is a division of U.S. patent application Ser. No. 08/128,470, filed Sep. 28, 1993.

BACKGROUND OF THE INVENTION

The present invention relates to a paper machine suction roll comprising a revolving mantle loop and a stationary suction shoe arranged inside the mantle loop and connected to a source of negative pressure.

The present invention also relates to a method for dewatering a web in a forming section having a twin-wire forming zone in which the web passes over at least one suction roll comprising a revolving mantle loop and a stationary suction shoe.

Suction rolls are typically employed at the wet end in paper machines, i.e., in connection with the wire part and the press section, for example, as a web forming roll, couch roll, pick-up roll, felt conditioning roll, and press roll.

Prior art suction rolls typically consist of a revolving perforated mantle cylinder and an axial suction box placed inside the cylinder. The suction box is arranged to follow an inner face of the cylinder mantle by means of seal ribs. The width of the suction zone in a typical suction box is usually from about 100 mm to about 500 mm and the suction box extends from end to end in the mantle. The suction box communicates with a suction system so that negative pressure is produced. Air flows through holes placed in the sector in the cylinder mantle of the suction roll which faces the suction box at each particular time during rotation of the roll.

Prior art suction rolls operate in a manner so that the wet paper web formed in the former of a paper machine is passed on support of a wire or felt over the suction zone of the suction roll. The negative pressure effective at locations within the suction roll promotes the removal of the water, which is separated from the web, and its flow into the structure of the wire or the felt and, further, into the holes in the suction roll. By the effect of the suction, water may enter through the holes into the suction box, or water may also remain in the holes in the suction roll. In the latter case, the water remains in the holes as long as the holes are subjected to the effect of the suction and air flows through the holes. However, the water is ejected out of the roll after the holes lave passed beyond the suction zone.

The thickness of the cylinder mantles of prior art suction rolls is typically from about 30 mm to about 100 mm depending on the other dimensions of the roll. The roll diameter and the mantle thickness are selected so that the deflection of the suction roll remains within permitted limits during operation of the paper machine.

Generally, a suction roll situated in a wire part has from about 10,000 to about 12,000 holes per $m^2$, and the diameter of each hole is from about 5 mm to about 6 mm. In the suction rolls arranged in the press section, the number of holes is higher, but the diameter of each hole is smaller, e.g., from about 4 mm to about 5 mm.

Suction rolls are considered expensive parts of paper machines in relation to the other individual components of the paper machine. In particular, the drilling of a large number of holes into the roll produces high manufacturing and related costs. The perforations, i.e., holes, reduce the strength of the mantle, for which reason it is necessary to use special metal alloys as the raw material of the rolls as well as a relatively thick mantle. Thus, there is also a high cost of material to produce the suction rolls which results in high manufacturing cost.

The quantity of air that enters into the suction box in a suction roll and that must be dealt with by the suction pump in the suction system communicating with the suction rolls is derived from three sources:

1) from the air coming through the web,
2) from the air entering into the suction zone along with the holes during each revolution of the suction roll ("hole air"), and
3) from stealth air, which enters into the suction box as a result of seal leaks. The amount of stealth air is usually quite low as compared with the other two air quantities.

The following example gives an idea of the ratio between the first two afore-mentioned quantities of air, i.e., the air coming through the web and the "hole air". The numbers provided below refer to the characteristics of a paper-machine suction roll whose length is about 10 meters and in which the width of the suction box is about 110 mm, and the negative pressure applied to produce the suction effect is about 65 kPa. At a machine speed of about 1500 meters per minute, the proportion of air coming along with the holes is about 260 $m^3$ per minute, and the proportion of the air passing through the web is less than about 200 $m^3$ per minute.

With modern high-speed paper machines, the amount of air that enters into the suction zone of the suction roll, and suction system connected thereto, along with the air passing through the holes, i.e., the hole air, has proved to be surprisingly high. As the running speeds of paper machines increase, the proportion of the "hole air" will also increase. This proportion is increased further by the fact that, with increasing machine speeds, the rolls must be made ever stronger. Rolls are made stronger by, e.g., increasing the thickness of the mantle. Thus, since the amount of hole air is proportional to the thickness of the roll mantle, an increase in the thickness will have a corresponding increase in the amount of "hole air" passed into the suction system.

In order to reduce related utility expenses of operating the suction system to compensate for the "hole air", it is desirable to reduce the proportion of "hole air" to a practically insignificant level. For example, in a newsprint machine whose running speed is about 1500 meters per minute and trimmed width about 9.5 meters, the total suction pump capacity required for dealing with the hole air, with respect to all the suction rolls in the newsprint machine, is about 72,000 $m^3$ per hour, and the corresponding motor power connected to the suction pumps is about 1600 kW. If the suction pump capacity can be lowered by about 1000 kW, this results in a savings of more than about 7 million kWh per year. Therefore, there is a considerable advantage to reducing the amount of hole air passed into the suction system.

A particular operational and technical drawback related to prior art suction rolls used in paper machines is that the suction rolls produce intensive noise which can cause even serious damage to the health of the workers operating the paper machine. This noise is generated since the holes in the suction roll operate as a sort of whistles. When the holes under vacuum enter outside the suction zone, they are filled with air as a pulse which produces a strong whistling sound having a basic frequency determined by the length of the drill pattern of the holes. The system of whistles formed by the high number of holes in the suction roll often produces a noise that exceeds the pain threshold of the ears.

In the prior art, attempts have been made to attenuate this noise by means of various arrangements, for example, by using a suitable drilling pattern of the holes or sound-insulating walls. However, in practice it has not been possible to achieve significant attenuation of this noise by means of the prior art solutions. It is thus desirable to significantly reduce the noise of the suction rolls to inhibit the related problems.

With respect to the prior art related to the present invention, reference is made to published Finnish Patent Application No. 762620 (Matti Kankaanpaa) of the assignee, Valmet Paper Machinery Inc., and to corresponding U.S. Pat. No. 4,172,759, the specification of which is incorporated by reference herein. In this reference, a method is described for subjecting a web, or a fibrous suspension layer, that is passed on support of a felt or wire over a roll in a paper machine, or an equivalent web, wire or felt, to a suction effect. In the method, the sector of the roll which is not covered by the object subject to the suction effect, communicates with the suction system from outside the roll.

Further, this reference describes a roll device that comprises a revolving suction roll provided with through perforations, or a corresponding grooved solid-mantle roll, and a suction chamber extending over a considerably large sector of the roll. The suction chamber is provided with a mantle whose edges have seal parts placed in contact with the roll. The ends of the suction chamber have seals that are in contact with the outer faces of the ends of the roll mantle. The roll device also includes members arranged to facilitate the connection between tile suction chamber and a suction pump and additional members arranged to remove the water collected in the interior of the suction chamber.

In prior art suction rolls, it is a further drawback that, in some positions, the suction roll tends to apply a marking to the paper web corresponding to the hole pattern in its mantle.

Also, in the prior art, suction devices placed in the wire part of a paper machine are known to include a perforated belt fitted between two guide rolls. The belt has a straight planar run between the guide rolls which is fitted against the inner face of the forming wire. A suction box is arranged inside the belt loop. These devices have not been used more commonly because one of their drawbacks are problems related to the structure and the control of the perforated belt, including transverse instability.

The highest running speeds of paper machines currently in operation are already in a range of about 1500 meters per minute, and at present, machines are being contemplated whose speeds will be in the range of at least about 2000 meters per minute. With these high running speeds, the problems discussed above will be manifested with increased emphasis. With increasing running speeds and widths of paper machines, it is also necessary to increase the diameters of the suction rolls. However, the raw-materials and technical aspects of the roll production processes, in particular centrifugal casting of the roll mantle, impose limitations on the construction of large-diameter suction rolls.

OBJECTS AND SUMMARY OF THE INVENTION

Accordingly, it is an object of the present invention to provide new and improved solutions for the problems discussed above and to substantially eliminate the drawbacks of the prior art suction rolls.

It is another object of the present invention to provide a new and improved suction roll, the operation and use of which provides a significant reduction of the noise level emanating from the suction roll.

It is yet another object of the present invention to provide a new and improved suction roll, the operation and use of which provides a reduction in the proportion of "hole air" to a practically insignificant level.

It is still another object of the present invention to provide a new and improved suction roll which can be used in prior art web formers so that existing constructions of the prior art devices do not have to be changed to employ the suction roll in accordance with the present invention.

It is yet another object of the present invention to arrange a web former to dewater a web in which at least one suction roll in accordance with the invention is utilized to provide increased dewatering capacity and reduced operating costs.

In view of achieving the objects stated above and others, the suction roll in accordance with the invention includes a mantle loop which is a permeable fabric-sock loop that substantially receives water. The fabric-sock loop may be, if necessary, supported by means of guide members arranged inside the loop. The suction shoe in the suction roll is provided with a permeable guide deck against which an inner face of the fabric-sock loop glides. The permeability of the guide deck is achieved by perforating the mantle of the guide deck and/or by arranging grooves in the guide deck.

In the present invention, the suction shoe and its associated perforated and/or grooved guide deck are preferably in a stationary position. The holes, grooves, or equivalent, in the guide deck do not have to be evacuated of air since the holes are constantly subjected to vacuum pressure. As a result of this construction, a suction system of substantially lower suction capacity and lower output is adequate (when compared to a comparative prior art suction roll). For this reason, substantial economies and savings are obtained both with respect to the suction system itself and with respect to the system of suction ducts. Moreover, since the holes in the suction shoe used in the invention are not constantly emptied and filled with air, the suction roll in accordance with the invention does not produce the noise that is characteristic of the prior art suction rolls.

The suction roll in accordance with the invention is more favorable as compared with prior art suction rolls for several reasons. One particular reason is that the perforations in the suction shoe are needed at the suction zone only. In this manner, only one particular section of the suction shoe is perforated as opposed to an entire roll being perforated as in prior art devices. Another reason is that the suction chamber is stationary with respect to its perforated deck.

In a suction roll in accordance with the invention, the guide deck of the stationary suction shoe guides the fabric-sock loop under tension along a curved path to thereby provide a stable run of the fabric-sock loop over the suction zone.

The fabric-sock loop used in the present invention is generally substantially thicker than a normal forming wire. The structure of the fabric-sock loop is dimensioned quite open, so that it has a relatively high water-receiving capacity. The water removed from the web is transferred through the forming wire into the permeable, relatively open structure of the fabric-sock loop by the effect of negative pressure on the suction zone of the suction shoe. From the interior of the fabric-sock loop, the water is removed during its circulation outside the suction zone.

At the inlet side of the guide deck of the suction shoe, water-jet devices are preferably used to lubricate the glide face between the inner face of the fabric-sock loop and the outer face of the deck of the suction shoe. Around the fabric-sock loop, a water collecting trough is arranged to collect water removed from the water-receiving structure of the loop.

In a preferred embodiment, the fabric-sock loop is constructed so that both of its ends are attached to circular end flanges. The end flanges are connected to journalling bushings by means of which the fabric-sock loop is driven in a rotation around the suction zone. The space outside the suction zone and inside the fabric-sock loop is preferably slightly pressurized to promote the retaining of the fabric-sock loop in its cylindrical shape, to maintain the axial tension of the loop, and/or to promote the draining of water outward from the structure of the fabric-sock loop.

In the method in accordance with the present invention, a wire having a web thereon is engaged with a substantially water-receiving fabric-sock mantle loop. A region of the loop engaged with the wire and web thereon is passed over a stationary suction shoe such that an inner face of the loop region glides against the suction shoe. Negative pressure is applied through the suction shoe to draw water from the web while the loop is being driven around the suction shoe causing the wire and web thereon to separate from the loop after passing over the suction shoe. Water is removed from the loop after the wire and web are separated therefrom. Further, the outer face of the suction shoe on which the loop glides can be lubricated by, e.g., water jets.

In a preferred embodiment, guide rolls are arranged to support the loop in its movement around the suction shoe. A drive roll is arranged to form a drive nip with one of the guide rolls to thereby drive the loop around the suction shoe. Instead of or in addition to the drive nip, another possible drive means is to fasten the loop to end flanges of a suction roll and rotate the suction roll to thereby cause the loop to pass over the stationary suction shoe. A curved guide deck is arranged in the suction shoe and includes perforations such that suction is constantly applied through the perforations to the web.

In the following, the invention will be described in detail with reference to some exemplifying embodiments of the invention illustrated in the figures in the accompanying drawings, the invention being by no means strictly confined to the details of the exemplifying embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
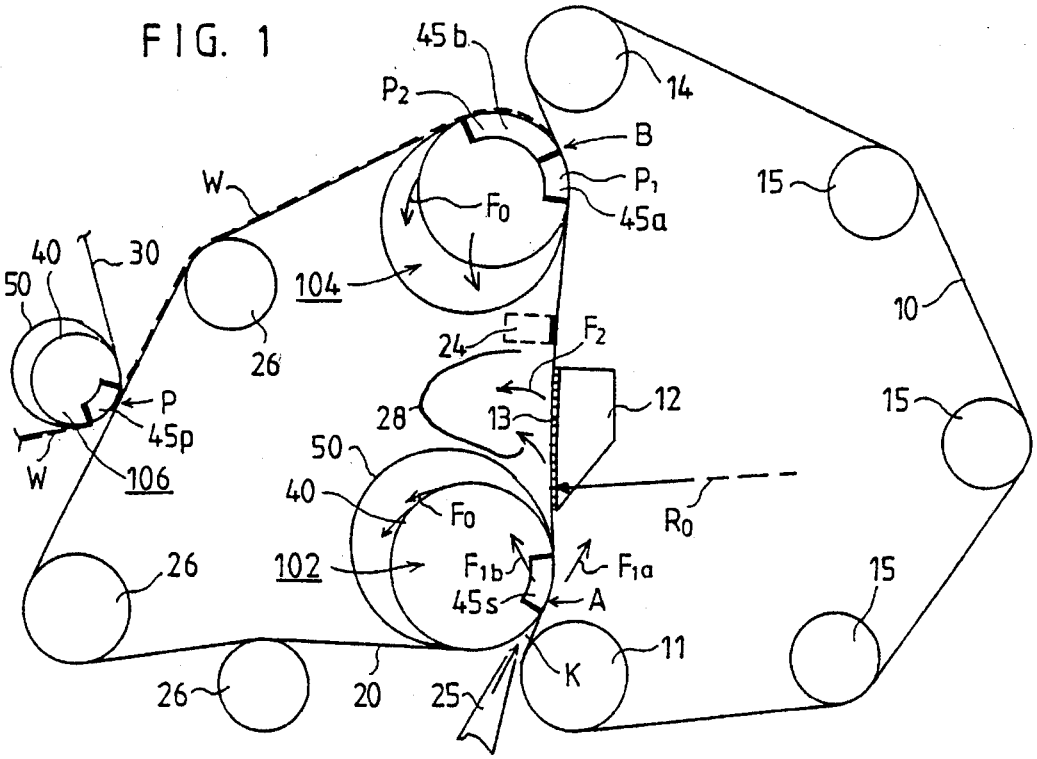
FIG. 1 is a schematic side view of a twin-wire former in which suction rolls in accordance with the present invention are used as two web-forming rolls and as a pick-up roll.
Figure 2:
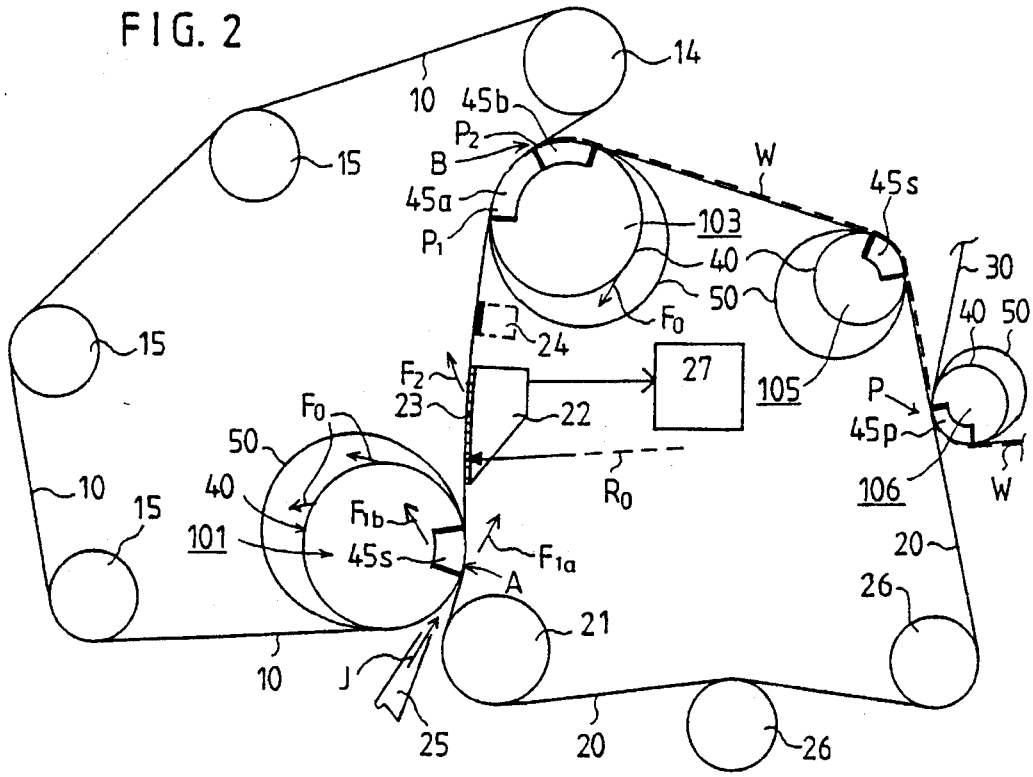
FIG. 2 is a schematic side view of a twin-wire former in which there are two suction rolls in accordance with the invention in the twin-wire zone and additionally, inside the loop of the carrying wire, a suction roll in accordance with the invention is used as a wire suction roll as well as a fourth suction roll in accordance with the invention used as a pick-up roll.

FIGS. 1 and 2 show twin-wire formers of a paper machine in which a loop of a first wire 10 and a loop of a second wire 20 carry the web through the dewatering stages. The wires 10,20 have a joint run between points A and B which define the twin-wire forming zone of the former. The joint run may either be curved, horizontal, vertical or inclined. The wire 10 is a so-called covering wire, and the wire 20 a so-called carrying wire which the web W follows after the twin-wire forming zone. Slice part 25 of a headbox feeds a pulp jet J into a forming gap K defined by the wires 10 and 20. The dimensions of gap K are determined by the relative positions of rolls 11,102;21,101 over which the wires run. The gap K is defined at one side substantially by the run of the wire 10;20 from the roll 11;21 to the point A, where the wire 10;20 meets the other wire 20;10 (the pulp layer is formed between the wires), and at the other side by the wire 20;10 that runs over a first forming roll 102; 101. The first forming roll 102; 101 is a sock suction roll 100 in accordance with the invention.

Dewatering of the pulp layer or web takes place on a suction sector 45*s* of the first forming roll 102;101 both in a direction toward the forming roll 102;101 and in a direction away from it in the directions of the arrows $F_{1b}$ and $F_{1a}$, respectively.

A forming shoe 12; 22 is arranged after the forming roll 102;101 inside the loop of the wire 10;20 in the twin-wire forming zone A-B. Forming shoe 12;22 comprises a deck part consisting of ribs 13;23 arranged to form gaps therebetween. The curve radius of the deck part 13;23 of the shoe 12;22 is denoted with $R_o$.

In the areas of the forming roll 102;101 and the forming shoe 12;22, the joint run of the wires is curved in opposite directions, i.e., the direction of curvature of the deck part 13;23 is opposite to the direction of curvature of the first forming roll 102;101. The deck part 13; 23 may be arranged in either the loop of the covering wire 10 (FIG. 1) or the loop of the carrying wire 20 (FIG. 2) depending on the press section.

As shown in FIG. 2, the forming shoe 22 communicates with a suction pump 27. A suction flatbox 24 is placed after the forming shoe 12;22 inside the loop of the carrying wire 20 and operates to drain more water from the web. The flatbox 24 is followed by a second forming roll which is also a sock suction roll 104;103 in accordance with the present invention. Roll 104;103 is placed inside the loop of the carrying wire 20. In the area of the second suction roll 104;103, the run of the wires 10,20 is turned about 90° to curve toward a pick-up point P where the web W is separated from the carrying wire 20.

The sock suction rolls 104;103 have two successive suction zones 45*a* and 45*b* in which negative pressures $P_1$ and $P_2$ are applied respectively. Although only two zones are shown, the rolls 104;103 may have any number of suction zones as desired. In the area of suction zone 45*b*, the web W is separated from the covering wire 10 and follows the carrying wire 20. Thereafter, the web W proceeds to the pick-up point P where it is separated from the wire 20 on the run between guide rolls 26 (FIG. 1) by means of a sock pick-up roll 106 in accordance with the invention, and suction zone 45*p* arranged thereon. The web is transferred onto the pick-up fabric 30 which carries the web W further into the press section of the paper machine (not shown). In FIG. 2, the web W proceeds to the pick-up point P where it is separated from the wire 20 on the run between guide roll 26 and a sock pick-up roll 105 in accordance with the invention.

As shown in FIG. 1, a water collecting trough 28 is arranged in the area inside of the wire loop 10 and opposite to the forming shoe 12 arranged inside the wire loop 20. The trough 28 guides the water that has been removed through the wire 20 (arrow $F_2$) to the side of the paper machine. The guide rolls of the wire 10 are denoted with reference numerals 14 and 15, and the guide rolls of the other wire 20 with reference numeral 26. As shown in FIG. 2, inside the loop of the carrying wire 20, there is a wire suction roll consisting of a sock suction roll 105 in accordance with the invention, which has a suction zone 45*s*.

With the exception of the utilization of sock suction rolls 101, 102,103,104, 105, and 106 in accordance with the invention, the twin-wire former geometries shown in FIGS. 1 and 2 are in themselves known in the prior art, and they are described in this connection just as a background for the invention and as a typical environment of application. It should be emphasized that the sock suction rolls 100;100A in accordance with the invention can also be applied in many other, different environments in the web former of a paper machine and also elsewhere as desired.

Although vertical embodiments of web formers are shown, it is understood that the present invention also encompasses horizontal web formers wherein the twin-wire forming zone is arranged substantially in a horizontal direction.

Referring to FIGS. 3 to 6, a brief description will be given of the construction and operation of the suction roll in accordance with the invention, which is generally denoted with reference numeral 100 and also referred to as a sock suction roll. In the illustrated embodiments, roll 100 is a sock roll comprising a water-receiving and permeable fabric sock which is made of a permeable, water-receiving fabric loop 40. Fabric loop 40 revolves along with a first wire 10 (the covering wire in the embodiments of FIGS. 1 and 2) and a second wire 20 (the carrying wire in the embodiments of FIGS. 1 and 2) and is fitted between axially adjustable end flanges.

The running of the sock in the roll 100 is supported by a stationary suction shoe 45 arranged inside the loop 40 and, if desired, by guide rolls 41,41*a* mounted on the same frame as a suction shoe and/or by stationary support bars. Outside the loop 40, a water-removing trough 50 is arranged to collect the water that is removed from the web W and carried in the open and permeable structure of the loop 40. The suction shoe 45 has a curved deck 46 which is perforated and/or grooved and/or has a porous structure. Through holes 47, or equivalent apertures in the deck 46, are opened into the interior of the shoe 45 and communicate with a source of negative pressure $P_o$ through a suction duct 48*b*.

In the embodiments of FIGS. 3 to 6, the suction shoe 45 has two separate suction zones 45*a* and 45*b*, which can, if necessary, communicate with negative pressures $P_1$ and $P_2$ of different levels. Although only two suction zones are shown, there may be one or several suction zones as desired.

Additional structural details and variations of the construction of the sock roll 100 and the operation of the roll will be described in more detail below.

Figure 3:
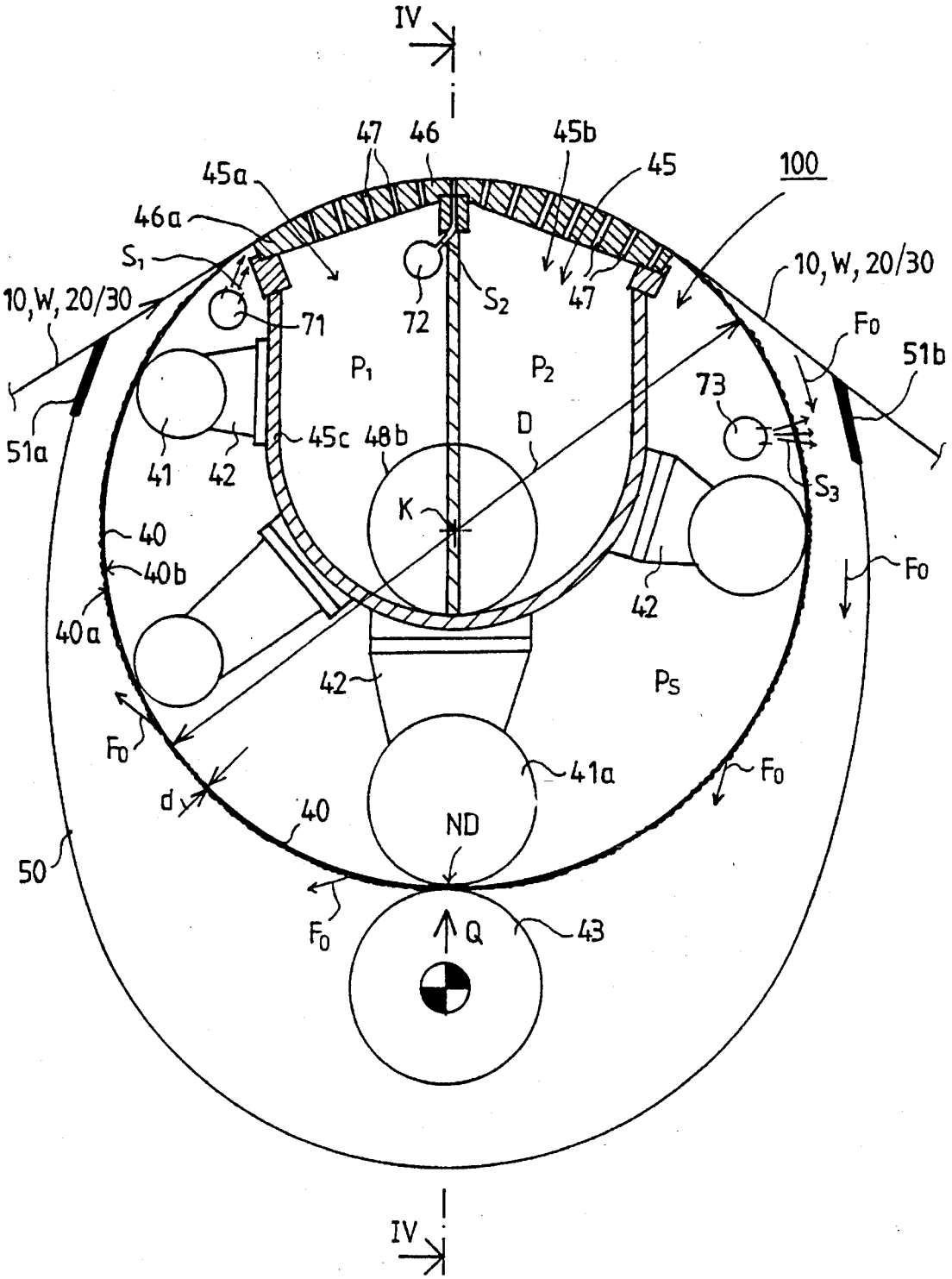
FIG. 3 is a vertical sectional view in the machine direction of a suction roll in accordance with the invention and also a sectional view taken along the line III—III in FIG. 4.
Figure 4:
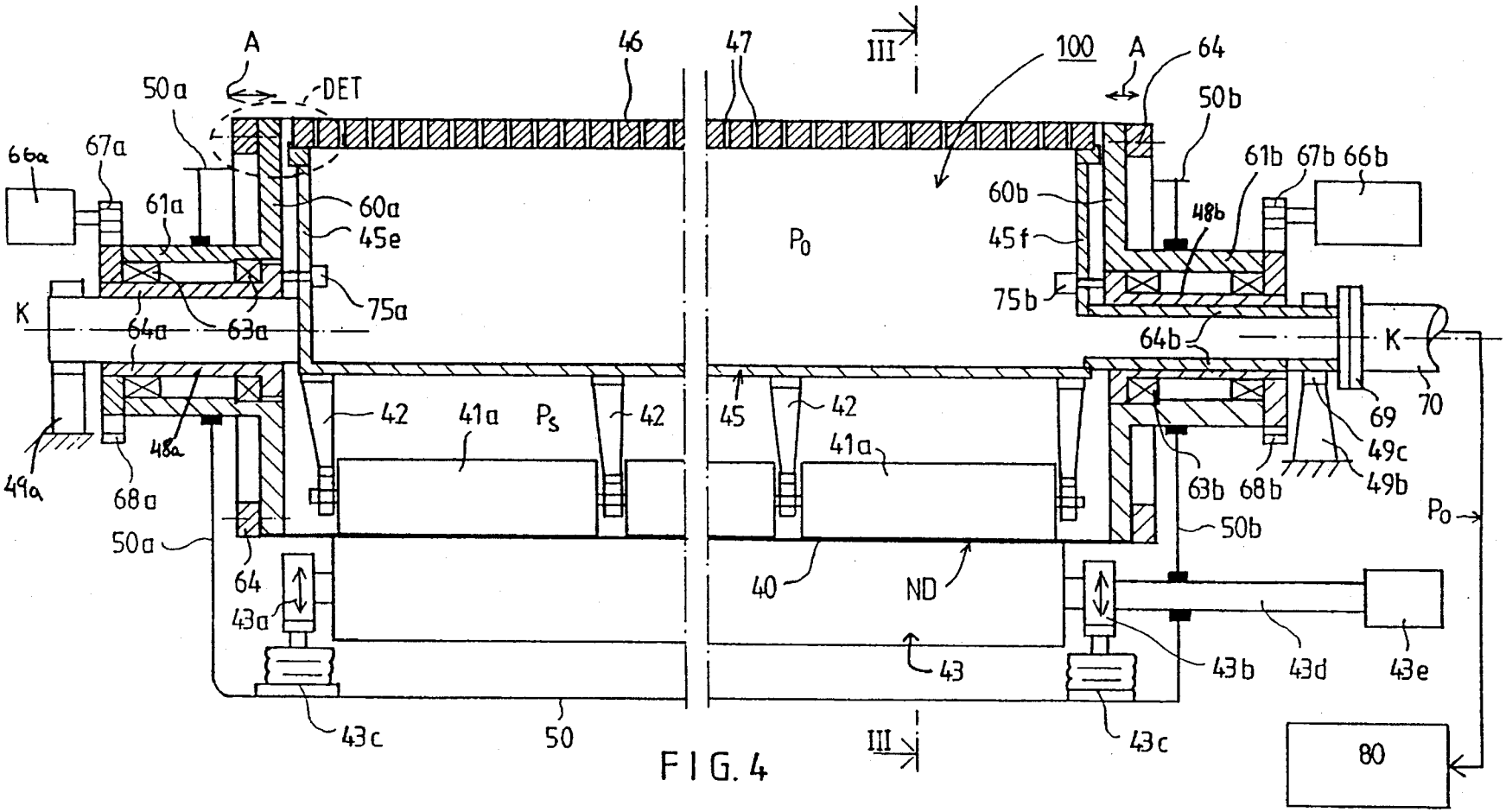
FIG. 4 is an axial vertical sectional view of a suction roll in accordance with the invention taken along the line IV—IV of FIG. 3.
Figure 4A:
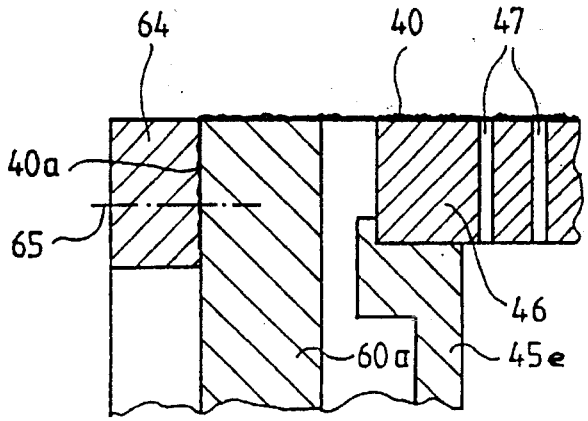
FIG. 4A is an enlargement of section DET of FIG. 4.

In the following, with reference to FIGS. 3, 4 and 4A, a detailed description will be given of an exemplifying embodiment of the invention. FIG. 3 is a vertical sectional view in the machine direction taken along the line III—III in FIG. 4, and, in a corresponding way, FIG. 4 is a central axial sectional view along the line IV—IV in FIG. 3. FIG. 4A shows an enlargement of the section denoted DET in FIG. 4.

As shown in FIGS. 3, 4 and 4A, the fabric-sock loop 40 is attached by its ends to end flanges 60*a* and 60*b* by means of a joint or edge 40*a* shown in FIG. 4A. Journalling bushings 61*a*,61*b* project from the end flanges 60*a* and 60*b*. Bearings 63*a*,63*b* are arranged on stationary shafts 64*a*,64*b* in the interior of bushings 61*a*,61*b*. A suction pipe 48*b* is arranged in the interior of one of the shafts, e.g., shaft 64*b*, and is attached to a suction pipe 70 by means of a flange 69. Suction pipe 70 is connected to and communicates with a vacuum pump 80 which is illustrated schematically in the figure. The vacuum pump 80 functions as one possible source of negative pressure for the suction roll in accordance with the present invention.

At the opposite end of the sock suction roll 100, opposite with respect to the suction duct formed by the flange 69 and suction pipe 70, there is an axle journal 48*a*, which is connected to a support frame or support flange 49*a* in the same way as the suction pipe 48*b* is connected to a support frame or flange 49*b*. The shafts, i.e., axle journal 48*a* and suction pipe 48*b*, are attached to a frame placed inside the sock loop 40 of the suction roll 100. The frame also includes the suction shoe 45 and its supporting structure. Between the shafts 48*a*,48*b* and the support flanges 49*a*,49*b*, it is possible to use a pivoting arrangement 49*c* so that the position of the sock suction roll 100 can be set within certain limits.

The sock loop 40 revolves around a central axis K-K and is driven by motors 66*a*,66*b* or other suitable drive means. From the motors 66*a*,66*b*, the drive power is passed to cogwheels 67*a*,67*b*, connected to the respective motors, which drive a toothed rim 68*a*,68*b* placed at the end of the bearing and journalling bushings 61*a*,61*b*. The run of the sock loop 40 is guided by guide rolls 41,41*a* which are mounted by means of flanges 42 in connection with the frame of the suction roll 100 and with the suction shoe 45.

According to FIGS. 3 and 4, it is possible to drive the sock loop 40 by means of a roll 43 in addition to the drive force being provided by the motors 66*a*,66*b*. In this manner, the sock loop 40 is driven by the roll 43 which forms a drive nip ND with guide roll 41*a*, which in the embodiment illustrated in FIG. 3 is a fragmentary roll. In order to produce a linear load Q in the drive nip ND, the roll 43 is mounted at both of its ends on bearing supports 43*a*,43*b*, which are loaded against the sock loop 40 and against the fragmentary roll 41*a* by means of a bellows device 43*c*. The roll 43 is driven by means of a motor 43*e* and a shaft 43*d* connected thereto which revolves synchronously with the motors 66*a*,66*b* and with the drives of the wires 10,20 and/or of the felt 30.

The sock loop 40 is operated along a circular path whose diameter is denoted with D in FIG. 3. In the present invention, diameter D is typically in a range of from about 0.8 meter to about 2.5 meters, which is generally substantially larger than the diameter of a normal suction roll provided with a revolving perforated mantle. Preferably, the diameter of the suction roll in accordance with the invention is from about 1.0 meters to about 1.6 meters.

The sock loop 40 is kept substantially tight during its operation both in the machine direction and in the axial direction. The axial tension can be produced by using pressing means, e.g., hydraulic actuators 75*a*,75*b*, to press bushings 64*a*,64*b* in an axial direction (as indicated by arrow A)such that the tensioning force is transferred by means of bearings 63*a*,63*b* to the end flanges 60*a*,60*b* of the sock loop 40. As shown in FIG. 4A, the edge 40*a* of the sock loop 40 is folded against the end flange 60*a* and secured in its place by means of a fastening ring 64 and screws 65 (shown schematically with a line of dots and dashes).

In an alternative embodiment, it is possible to construct the suction roll in accordance with the invention such that only the journalling bushing 64*a*/64*b* at one end of the roll is adjustable in the axial direction.

The construction of the suction shoe 45 includes a frame part arranged inside the sock loop 40 and which comprises transverse walls 45*c* and end walls 45*e* and 45*f* as well as one or more partition walls 45*d*. A stationary perforated guide deck 46 is fixed to the suction shoe 45. The flanges 42 supporting the guide rolls 41 may be arranged on the frame part, i.e., on the transverse walls 45*c* as shown in FIG. 3. An outer face of the guide deck 46 has a curve radius R and center line K-K that are the same as those of the sock loop 40 (i.e., R=D/2). Perforations 47 in the guide deck 46 extend through the guide deck 46 to thereby form through holes. Through the perforations 47, the suction effect is applied through the sock loop 40 to the web W that runs between the wires 10,20 or on the wire 10/20 and/or on the felt 30. The suction effect is generated by the vacuum pump 80 and applied through the closed structure of the suction roll to the perforations in the guide deck.

In another embodiment of the present invention, instead of, or in addition to, the perforations 47, it is possible to use various groove formations in the guide deck 46 to spread the suction effect. Further, instead of perforations 47 and grooves in the guide deck 46, it is possible to use a corresponding permeable porous guide deck construction, such as a deck formed by sintering, which spreads the suction effect very finely and uniformly. The perforations 47 and equivalent apertures are arranged so that the suction effect is distributed evenly in the transverse direction and shaped so that the friction between an inner face of the sock loop 40 and an outer face of the deck 46 is minimized.

A water jet device 71 is arranged before the guide deck 46 in the interior of the sock loop 40. The water jet device 71 operates in the direction of rotation of the sock loop 40 and applies jets $S_1$ to lubricate the glide face between the inner face of the sock loop 40 and the outer face of the deck 46. A corresponding supply of lubricating water, or other lubricating fluid, is also arranged in the middle of the guide deck 46, and is illustrated by a water feed pipe 72 and associated water jets $S_2$. Instead of, or in addition to, the lubricating devices described above, a supply of lubricating water may also be arranged to take place through the guide deck 46 by means of nozzle holes or equivalent formed in the guide deck 46. Inside the sock loop 40, it is also possible to arrange a water feed pipe 73 that keeps the sock clean by directing strong wash jets $S_3$ from the feed pipe 73 through the fabric structure of the loop 40. The wash jets $S_3$ also serve to force water out from the sock loop 40 into the water collecting trough 50.

The sock loop 40 is surrounded by the water draining trough 50 which is provided with seal ribs 51*a* and 51*b* operating against the inner face of the wire 10,20 or the felt 30. The water collecting trough 50 has end walls 50*a* and 50*b*. The trough 50 collects the water removed in the direction of the arrows $F_o$ from the water-receiving fabric structure of the sock loop 40. The removal of water from the loop 40 is promoted by a field of centrifugal force. From the interior of the trough 50, the waters are removed through a duct in itself known (not shown) to the side of the paper machine.

The sock loop 40 is a fabric-like member which is permeable and substantially water-receiving. The thickness d of the fabric loop 40 is generally substantially larger than the thickness of a normal forming wire 10,20, typically in a range of about 2 mm to about 10 mm, preferably in a range of from about 3 mm to about 5 mm. In the construction of the sock loop 40, modern, durable low-friction plastic materials, composites or metals or various combinations of same may be used.

Figure 7:
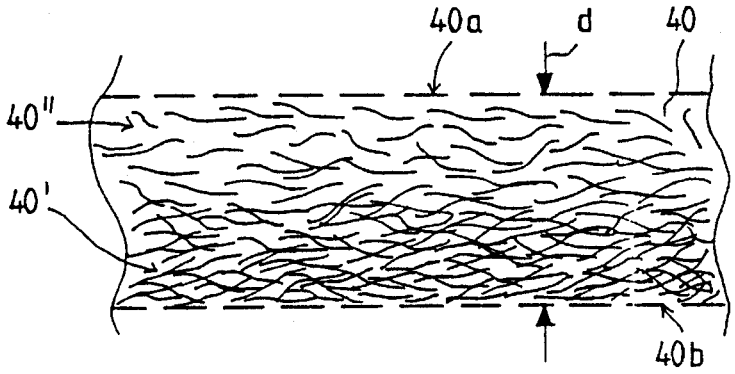
FIG. 7 is a sectional view of the fabric-sock structure used in the suction roll in accordance with the present invention.

FIG. 7 is a sketch of the structure of the sock loop 40, in which a portion 40' next to the inside face 40*b* of the loop 40 is made of a denser mesh-like, or equivalent, fabric structure having a higher flow resistance, whereas another portion 40" next to the outside face 40*a* of the loop 40 is made of a substantially more permeable fabric structure having a larger open face and lower flow resistance, preferably a mesh-like fabric structure made of plastic threads and/or fibers. The static friction and the kinetic friction between the outer face of the fabric structure of the sock loop 40 and the opposite filtering wire are substantially higher than the corresponding friction between the inner face of the fabric structure and the guide deck 46.

The sock loop 40 is a replaceable wearing part. The deck 46 of the suction shoe 45, in particular the face that rubs against the inner face of the loop 40, is made of a material which has a low friction and high wear resistance, such as ceramics or other special coatings. These materials provide a sufficiently low friction with the inner face 40*b* of the loop 40 by means of water lubrication only. The perforations and/or grooves and/or the equivalent porous structure in the guide deck 46 of the suction shoe 45 may have variable spacing and be shaped so that, at the inlet end of the guide deck 46, it is possible to use a fully impervious solid area 46*a*.

The interior of the sock loop 40 can be subjected to slight pressure $p_s$ if desired in order to keep the loop 40 in its shape and under axial tension even without using actuators 75*a*, 75*b*. By means of the pressure $P_s$, it is also possible to promote the removal of water outward from the fabric structure of the sock loop 40 (arrow $F_o$). The curve radius R of the guide deck 46 of the suction shoe 45 is preferably invariable and substantially constant. However, in the embodiment shown in FIG. 6, if necessary, it is also possible to use different guide decks 46 of variable curve radius. In this case, the tensioning pressure $p_T$ of the outer wire 10/20 can be varied. The tensioning pressure is, as is well known, $p_T$ equals T/R, wherein T is the tightening tension of the outer wire 10/20 and R is the curve radius of the guide deck 46.

The exemplifying embodiment of the invention illustrated in FIGS. 3 and 4 and described above is the most advantageous one, according to a present-day estimate. However, many other variations are possible within the scope of the inventive idea of the invention, some of them being described in the following with reference to FIGS. 5 and 6.

Figure 5:
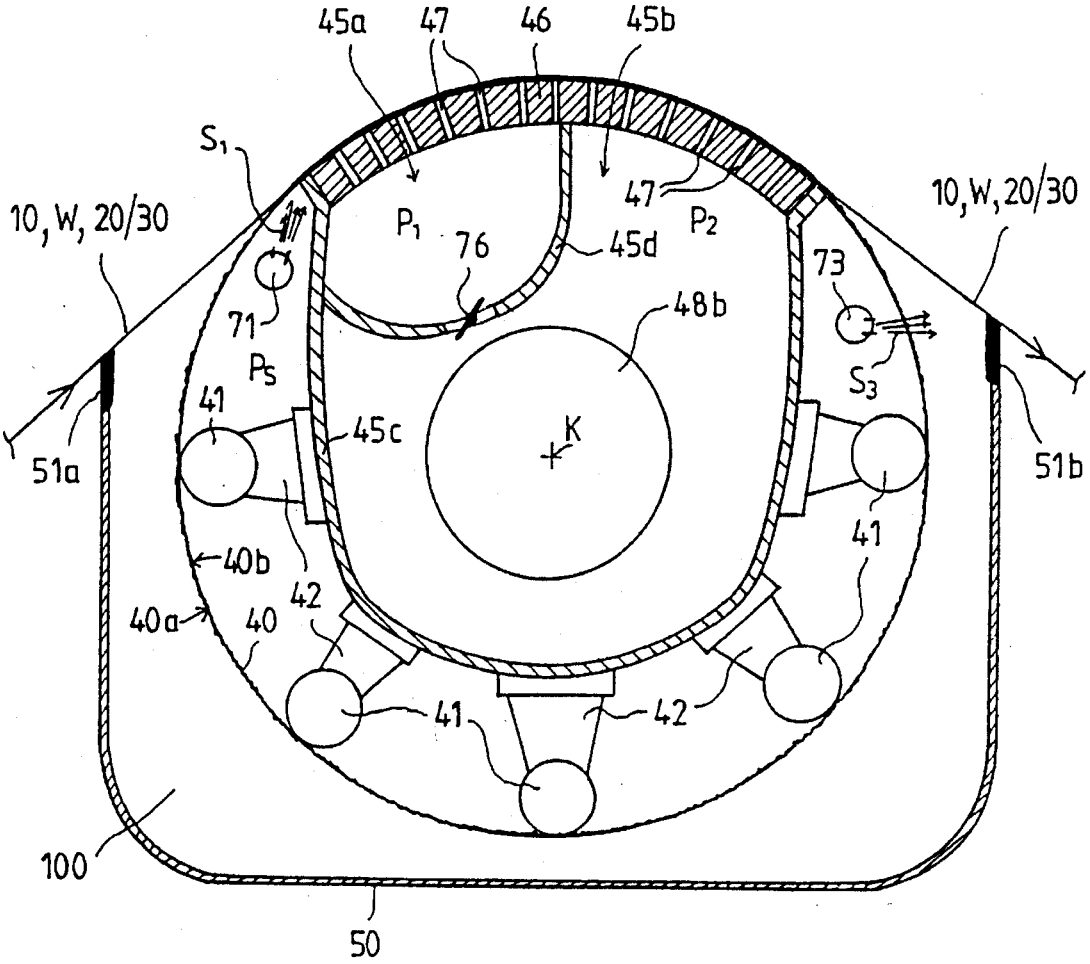
FIG. 5 is a vertical sectional view in the machine direction of a second embodiment of the suction roll in accordance with the invention.

FIG. 5 shows an embodiment of the invention which includes a small suction zone 45*a* which is arranged to operate on a portion of the guide deck 46. Zone 45*a* is separated by the partition wall 45*b* in the suction shoe 45. A lower level of negative pressure $P_1$ prevails in suction zone 45*a* than the level of negative pressure $P_2$ in suction zone 45*b* in the suction chamber. The reduced negative pressure, i.e., $P_1<P_2$, in the zone 45*a* is arranged by means of an adjustable throttle gate 76 which is located on the partition wall 45*d*, or other suitable means.

The embodiment of FIG. 5 also differs from the embodiment of FIG. 3 in the respect that the sock loop 40 has no roll nip drive ND (as shown in FIG. 3) Rather, in the embodiment of FIG. 5, the sock loop 40 is driven in the manner described with respect to the embodiment of FIG. 4, i.e., primarily by means of its end flanges 60*a*,60*b*.

In other embodiments of the present invention, it is possible to operate the sock loop 40 even without a roll nip drive or other drive means. In this case, the sock loop 40 operates and rotates because it is driven by the wires 10/20 and by the felt 30 which are constantly moving over the guide deck 46. Thus, the movement of the wires and the felt drag and pull the sock loop 40 over the guide deck to cause the sock loop to move. However, it is possible to use any of the above described drive means to drive the loop 40 in this embodiment.

Figure 6:
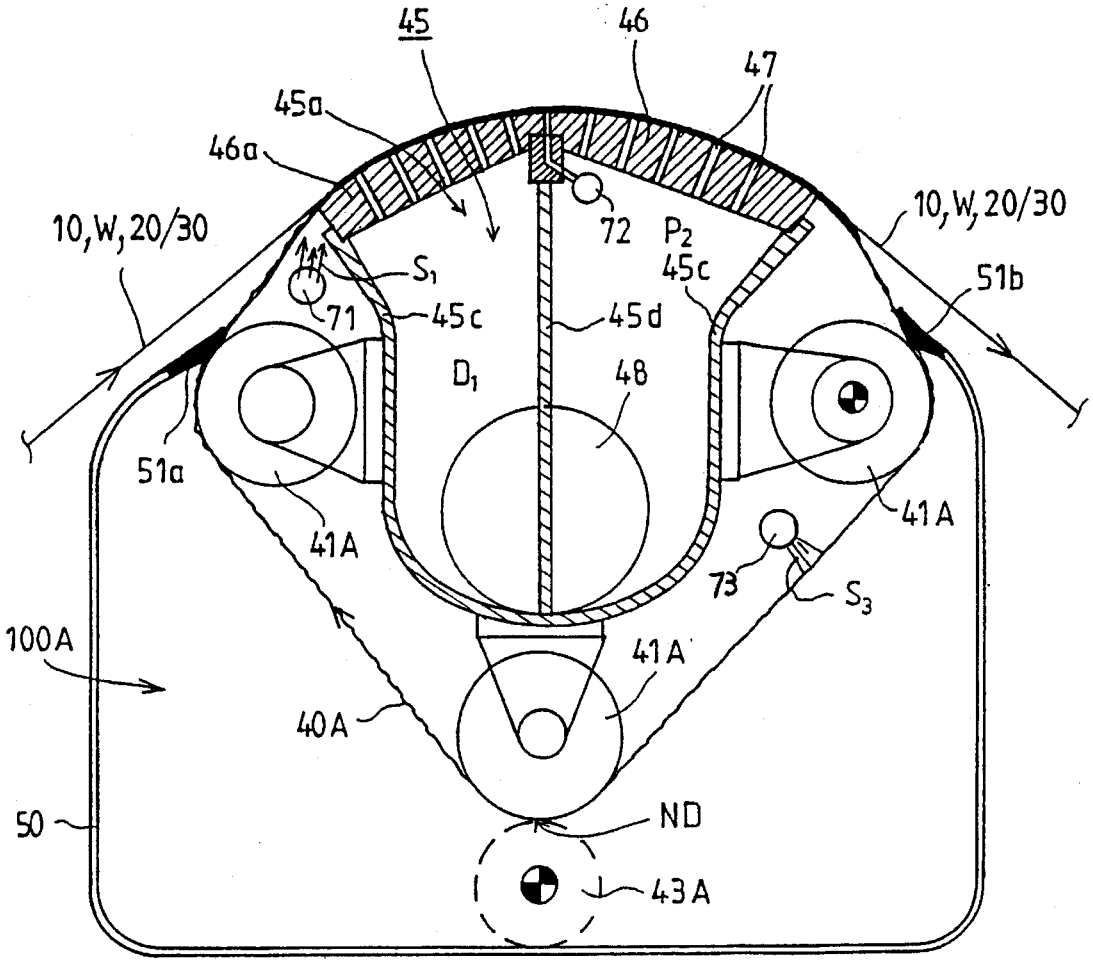
FIG. 6 is a vertical sectional view in the machine direction of a third embodiment of the suction roll in accordance with the invention.

FIG. 6 is a vertical sectional view in the machine direction of a second variation of the invention in which a sock loop 40A is guided by guide rolls 41A and does not have a circular path, but is shaped as a broken line, i.e., irregularly shaped. It is not necessary to close the ends of the sock loop 40A, but the axial tensioning of the loop 40A can be provided, e.g., by means of crowning of the guide rolls 41A. It is also possible to use a drive nip ND and a driven drive roll 43A in the way corresponding to FIG. 4.

Inside the sock loop 40A, a water feed pipe 73 is arranged to keep the sock clean by directing strong wash jets S3 from the pipe through the fabric structure of the loop 40. This also serves to force water out from the sock loop 40 into the water collecting trough 50. The sock loop 40 is surrounded by the water draining trough 50 which is provided with seal ribs 51*a* and 51*b* operating against the inner face of the wire 10,20 or the felt 30. The water feed pipe 73 is thus optimally placed in a location between the seal ribs 51*a*,51*b*. In the illustrated embodiment, the seal ribs 51*a*,51*b* are placed in close proximity to the guide rolls 41A, i.e., seal rib 51*a* is placed before the first guide roll and seal rib 51*b* is placed after the last guide roll, so that any water forced out as a result of the curvature of the guide rolls 41A enters into the trough 50.

The examples provided above are not meant to be exclusive. Many other variations of the present invention would be obvious to those skilled in the art, and are contemplated to be within the scope of the appended claims.

I claim:

1. A method for draining water from a paper web running on a wire, comprising engaging the wire and web thereon with a substantially water-receiving fabric-sock mantle loop, passing a region of the loop engaged with said wire and web thereon over a stationary suction shoe having a curved surface, guiding the mantle loop in a substantially circular path over the suction shoe such that an inner face of the loop region glides against the curved surface of the suction shoe, applying a negative pressure through the suction shoe to draw water from the web, and driving the loop around the suction shoe to separate said wire and web thereon from the loop after passing over the suction shoe.

2. The method of claim 1, further comprising removing water from the loop after said wire and web are separated therefrom.

3. The method of claim 1, further comprising lubricating an outer face of the suction shoe on which the loop glides.

4. The method of claim 1, further comprising arranging guide rolls to support the loop in its movement around the suction shoe and arranging a drive roll to form a drive nip with one of the guide rolls to thereby drive the loop around the suction shoe.

5. The method of claim 4, further comprising the step of arranging the drive roll and the guide roll in nip-defining relationship therewith in a water collecting trough having seal ribs engaging with an outer face of the loop.

6. The method of claim 1, further comprising fastening the loop to end flanges of a suction roll and rotating the suction roll to thereby cause the loop to pass over the stationary suction shoe.

7. The method of claim 1, wherein the curved surface comprising a curved guide deck having perforations such that the negative pressure is applied through the perforations to draw water from the web.

8. Use of a suction roll comprising a substantially circular, water-receiving fabric-sock mantle loop, and a stationary suction shoe arranged in said loop, said suction shoe being connected to a source of negative pressure to thereby provide suction and comprising a permeable, curved guide deck, said loop revolving about said suction shoe such that an inner face of said loop glides against said guide deck, as a forming roll in a web former of a paper machine, a wire suction roll, a pick-up roll, or a felt conditioning roll.

9. A method for draining water from a paper web running on a wire, comprising engaging the wire and web thereon with a substantially water-receiving fabric-sock mantle loop, passing a region of the loop engaged with said wire and web thereon over a stationary suction shoe having a curved surface, guiding the mantle loop over the suction shoe such that an inner face of the loop region glides against the curved surface of the suction shoe, applying a negative pressure through the suction shoe to draw water form the web, arranging guide rolls in a water collecting trough and inside the loop, arranging a drive roll in the water collecting trough outside the loop to form a drive nip with one of the guide rolls, and sealing the water collecting trough in which the drive roll and the guide roll in nip-defining relationship therewith are situated against an outer face of the loop.

10. The method of claim 9, further comprising the step of guiding the mantle loop in a substantially circular path.

* * * * *